United States Patent [19]

Kuki

[11] 4,232,892

[45] Nov. 11, 1980

[54] OUTSIDE DOOR HANDLE ASSEMBLY FOR VEHICLES

[75] Inventor: Nobuyuki Kuki, Toyota, Japan

[73] Assignee: Aisin Seiki Kabushiki Kaisha, Kariya, Japan

[21] Appl. No.: 898,041

[22] Filed: Apr. 20, 1978

[30] Foreign Application Priority Data

Mar. 31, 1977 [JP] Japan ..... 52-39902
Mar. 31, 1977 [JP] Japan ..... 52-39904

[51] Int. Cl.[2] ..... E05C 13/00
[52] U.S. Cl. ..... 292/347
[58] Field of Search ..... 292/216, 347, 336.3, 292/DIG. 31, DIG. 38

[56] References Cited

U.S. PATENT DOCUMENTS

| | | | |
|---|---|---|---|
| 3,400,446 | 9/1968 | Yulkowski | 292/347 X |
| 3,967,844 | 7/1976 | Torii et al. | 292/336.3 |
| 4,038,718 | 8/1977 | Reilhoc et al. | 292/DIG. 31 |
| 4,116,027 | 9/1978 | Tannery | 292/DIG. 31 |

*Primary Examiner*—Richard E. Moore
*Attorney, Agent, or Firm*—Sughrue, Rothwell, Mion, Zinn and Macpeak

[57] ABSTRACT

An outside door handle assembly for vehicles is comprised of a handle case secured to an outer panel of a vehicle door and a handle member including a handle operating portion made of plastics and an arm portion made of metal connected to the handle operating portion and rotatably supported on said handle case. The handle operating portion of the handle member is provided with a groove and a boss portion while the arm portion of the handle member is provided with two leg portions rotatably supported on the handle case, a bent portion having a connecting portion secured in the groove of the handle operating portion and a securing portion for receiving the bossed portion of the handle operating portion.

4 Claims, 8 Drawing Figures

OUTSIDE DOOR HANDLE ASSEMBLY FOR VEHICLES

BACKGROUND OF THE INVENTION

1 Field of the Invention:

The present invention relates to an outside door handle assembly and more particularly to an outside door handle assembly for vehicles.

2 Prior Art:

Outside door handles for motor vehicles which pivot about a substantially horizontal axis are old and well known in the art. Such pivoted door handles are usually located within a shallow recess in the door panel and are substantially exposed to the elements. Such door handle assemblies are generally made entirely of metal and are therefore fairly heavy and expensive to manufacture.

SUMMARY OF THE INVENTION

The outside door handle assembly according to the present invention provides a unique and highly simplified outside door handle assembly which is compact, inexpensive and lightweight. The outside door handle assembly according to the present invention includes a unique handle member which is a composite of plastics and metal materials. The handle member is comprised of a U-shaped metal arm portion having aligned apertures in each leg thereof to pivotably connect the arm portion to a handle casing with one leg adapted to be connected to a conventional door latch operating mechanism. An operating portion of plastics material is secured to the U-shaped metal arm portion along the connecting portion between the legs. The connecting portion of the metal arm portion is seated in a groove in the plastics operating portion and a bent tab on the connecting portion is provided with recess means for receiving connecting bosses integral with the plastics operating portion.

The outside door handle assembly according to the present invention includes a unique handle casing of plastics material having integrally formed projections which provide attachment means for the casing to the door of a vehicle and the handle member to the casing. The handle casing overlies the operating portion of the handle member to protect the handle member from the elements.

The foregoing and other objects features and advantages of the invention will be apparent from the following more particular description of preferred embodiments of the invention as illustrated in the accompanying drawings.

DETAILED DESCRIPTION OF THE INVENTION

Figure 1:
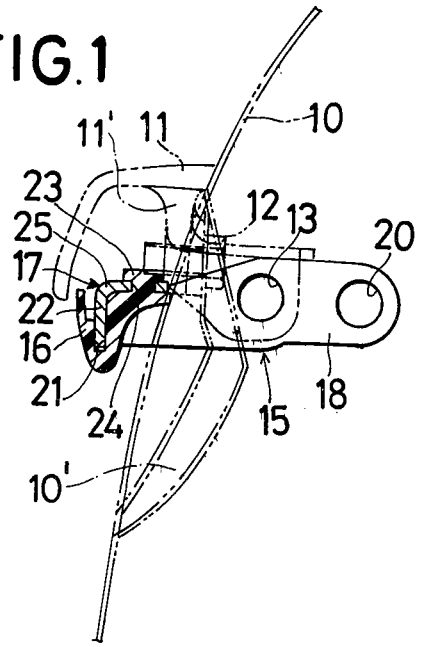
FIG. 1 is a side cross sectional view of an outside door handle assembly for vehicles according to the present invention.

In FIG. 1 the door handle according to the present invention is shown in cross section with the door handle casing and door panel being shown in phantom lines to give an idea of the operative relationship of the handle to the casing and panel. The door panel 10 of a vehicle is provided with a recess 10' for the mounting of the handle assembly and to provide clearance for the fingers of a person grasping the handle to operate the handle. A casing 11 which will be described hereinafter in greater detail is provided with integral projections 11', one of which is shown in FIG. 1, having a suitable aperture for the reception of a bolt 12 to secure the casing 11 to the door panel 10.

Figure 2:
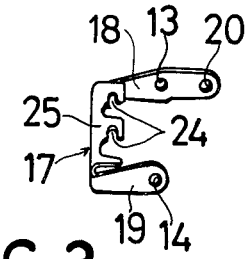
FIG. 2 is a prospective of the arm portion of the handle member according to the present invention.
Figure 3:
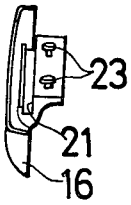
FIG. 3 is a prospective view of the operating portion of the handle member according to the present invention.
Figure 4:
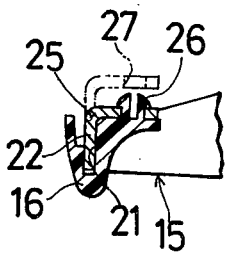
FIG. 4 is a view similar to FIG. 1 showing a second embodiment of the invention.

The handle member 15 is comprised of a plastics operating portion 16 shown in FIG. 3 and a U-shaped metal arm portion 17 shown in FIG. 2. The arm portion 17 is provided with a pair of parallel legs 18 and 19 having aligned apertures 13 and 14 respectively which will be disclosed adjacent the projections 11' of the casing 11 in alignment with apertures therein for the reception of pivot pins, not shown in FIGS. 1 and 2. The leg 18 extends beyond the pivot aperture 13 and is provided with a further aperture 20 adjecent the end thereof for connection to a conventional door latch operating mechanism. The legs 18 and 19 are joined by a connecting portion 22 having a bent tab 25 extending substantially at a 90 degree angle relative thereto. The tab 25 is provided with either slots 24 as shown in FIG. 2 or one or more holes 27 as shown in FIG. 4 for interlocking connection with projecting bosses on the plastics handle portion 16. The plastics handle portion 16 as best seen in FIGS. 1, 3 and 4 extends beyond the legs of the arm portion and is provided with a slot 21 which receives the connecting portion 22 of the arm portion and a pair of projecting mushroom shaped bosses 23 (FIG. 3) which cooperate with the slots 24 to secure the operating handle portion 16 to the arm portion 17. In the embodiment of FIG. 4 the bosses may be in the form of slotted mushroom shaped projections 26 which will snap into corresponding apertures 27 in the tab 25 on the arm portion 17.

Figure 5:
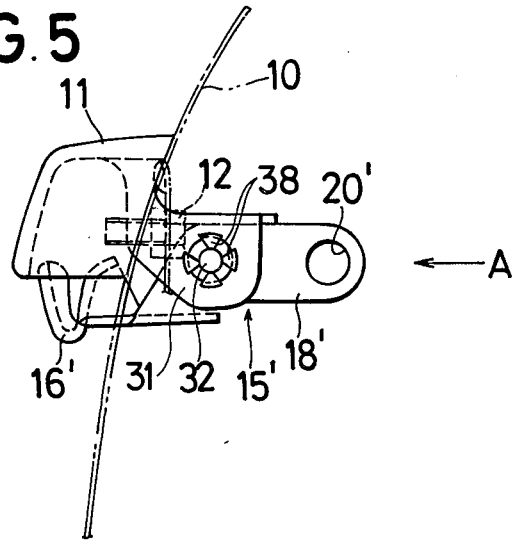
FIG. 5 is a side view of an outside door handle assembly showing a third embodiment of the invention.
Figure 6:
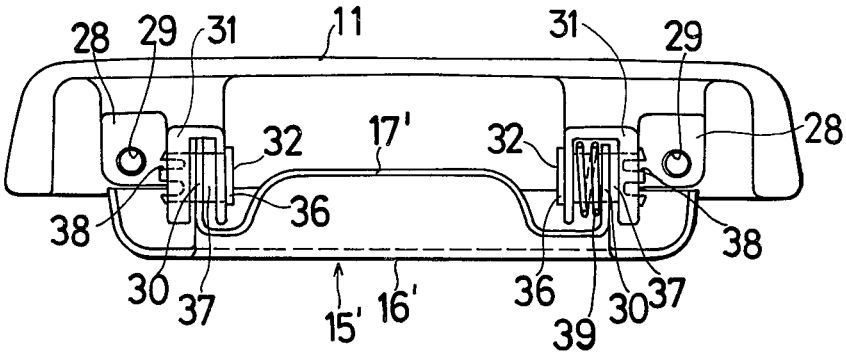
FIG. 6 is a view of the assembly shown in FIG. 5 taken in the direction of the Arrow.
Figure 8:
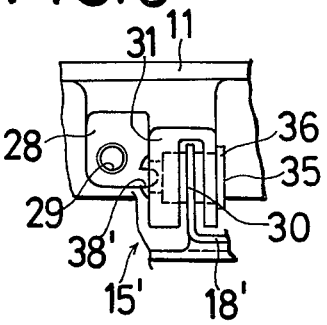
FIG. 8 is a partial view similar to FIG. 6 showing a fifth embodiment of the invention.

In FIGS. 5 and 6 a door handle assembly is shown which is comprised of the handle casing 11 and the handle member 16'. The integral projections 11' of the casing 11 shown in FIG. 1 are shown in greater detail in FIG. 6 and are comprised of a first attaching portion 28 having threaded apertures 29 therethrough for the reception of the bolts 12 to secure the casing 11 to the door panel 10 and second attaching portions 31 having apertures therethrough for the reception of pivot pins 32 which also extend through the apertures in the legs 30 of the arm portion 17' of the handle member 15' to pivotally connect the handle member 15' to the handle casing 11. An operating handle portion 16' is secured to the arm portion 17' of the handle member 15' in a manner similar to the manner in which the operating handle portion 16 is secured to the arm portion 17 of the handle member 15. The handle member 15 could be substituted for the handle member 15' in the arrangement shown in FIG. 5 and 6. The pivot pins 32 shown in FIGS. 5 and 6, which could also be used in the embodiment of FIG. 1, are made of plastics material. The pins 32 have an enlarged head 36 at one end and a slotted enlarged portion 38 at the opposite end which will allow the pin 32 to be inserted through the aligned apertures and snapped into position in a manner which will prevent withdrawal of the pins. The slotted end may have a substantially reduced diameter from the remainder of the pin 35 as shown at 38 in FIG. 8 as long as the aperture through which the slotted end 38 passes is sized accordingly.

Figure 7:
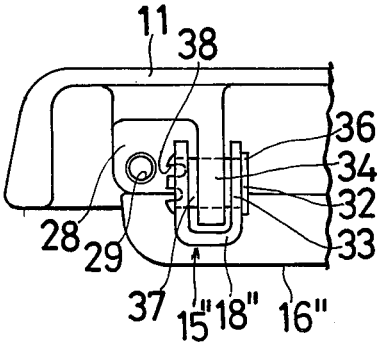
FIG. 7 is a partial view similar to FIG. 6 showing a fourth embodiment of the invention.

As shown in FIG. 7 the legs of the U-shaped arm portion of the handle member may also be U-shaped as shown at 18". In this instance the attaching portion 34 on the casing 11 would extend between the legs of the U-shaped leg 18" as opposed to the bifurcated arrangement of the projection 31 in FIG. 6.

It is obvious that the various types of connecting means for connecting the operating handle portion to the arm portion of the handle member are interchangeable in all embodiments. Likewise the various handle constructions which differ primarily in the shape of the legs of the U-shaped arm portions can be interchanged between the various embodiments. In each embodiment a spring such as the spring 39 shown in FIG. 6 may be associated with the pivotal connection of the handle member to the handle case to return the handle member to its normal position after use. While the invention has been particularly shown and described with reference to preferred embodiments thereof it will be understood by those in the art that the foregoing and other changes in form and details may be made therein without departing from the spirit and scope of the invention.

What is claimed is:

1. An outside door handle assembly for vehicles comprising, a handle case having means for securing said case to an outer panel of a vehicle door and a handle member including a handle operating portion made of plastics and an arm portion made of metal connected to said handle operating portion and rotatably supported on said handle case, said handle operating portion of said handle member being provided with a groove and boss means and said arm portion of said handle member being provided with two leg portions rotatably supported to said handle case, a bent portion having a connection portion inserted into said groove of said handle operating portion and a securing portion for receiving and securing said boss means of said handle operating portion.

2. An outside door handle assembly for vehicles as set forth in claim 1, wherein said arm portion of said handle member has a substantially U-shaped configuration.

3. An outside door handle assembly for vehicles as set forth in claim 1, further comprising pivot pin means made of plastics for rotatably supporting said arm portion of said handle member to said handle case.

4. An outside door handle assembly for vehicles as set forth in Claim 1, wherein said handle case is provided with integral one piece connecting portions for rotatably supporting said two leg portions of said handle member by means of said pivot pin means extending therethrough.

* * * * *